US007382998B2

(12) United States Patent
Murrell

(10) Patent No.: US 7,382,998 B2
(45) Date of Patent: Jun. 3, 2008

(54) ROBUST DOOR PANEL BREAKAWAY MECHANISM FOR AN IMAGE FORMING DEVICE

(75) Inventor: Niko Jay Murrell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 513 days.

(21) Appl. No.: 11/211,818

(22) Filed: Aug. 25, 2005

(65) Prior Publication Data

US 2007/0048004 A1 Mar. 1, 2007

(51) Int. Cl.
*G03G 15/00* (2006.01)

(52) U.S. Cl. ..... 399/107; 399/392

(58) Field of Classification Search ..... 399/107, 399/110, 124, 392, 393; 271/9.09; 361/725; 312/327, 328

See application file for complete search history.

(56) References Cited

U.S. PATENT DOCUMENTS 4,429,863 A * 2/1984 Itoh et al. ..... 271/9.09
5,145,160 A * 9/1992 Nagashima et al. ..... 271/9.09
6,215,970 B1 * 4/2001 Yoshikawa et al. ..... 399/124
6,330,423 B1 * 12/2001 Kitazawa ..... 399/392
6,641,318 B2 * 11/2003 Yergenson ..... 400/625
7,343,118 B2 * 3/2008 Ahn et al. ..... 399/124
2005/0141937 A1 * 6/2005 Nishimura ..... 399/392

FOREIGN PATENT DOCUMENTS

JP 55138759 A * 10/1980
JP 59086546 A * 5/1984
JP 04085260 A * 3/1992
JP 04256642 A * 9/1992
JP 2004045940 A * 2/2004

* cited by examiner

*Primary Examiner*—Robert Beatty
(74) *Attorney, Agent, or Firm*—Coats & Bennett, PLLC

(57) ABSTRACT

A breakaway device and method that may be used in conjunction with a door panel on an image forming device. The door panel may be a multipurpose feed door or otherwise provide access to the interior of the image forming device. The door panel may be movable between a closed position and an open position. The breakaway device may also permit door panel movement to a breakaway position that is beyond the open position. The breakaway device may include a resilient member and a deflectable stopper member. The stopper member may be biased by the resilient member into a first stopper position when the door panel is between the closed position and the open position. However, the stopper member may be displaced by the door panel against a bias force applied by the resilient member when the door panel is positioned between the open position and a breakaway position.

23 Claims, 10 Drawing Sheets

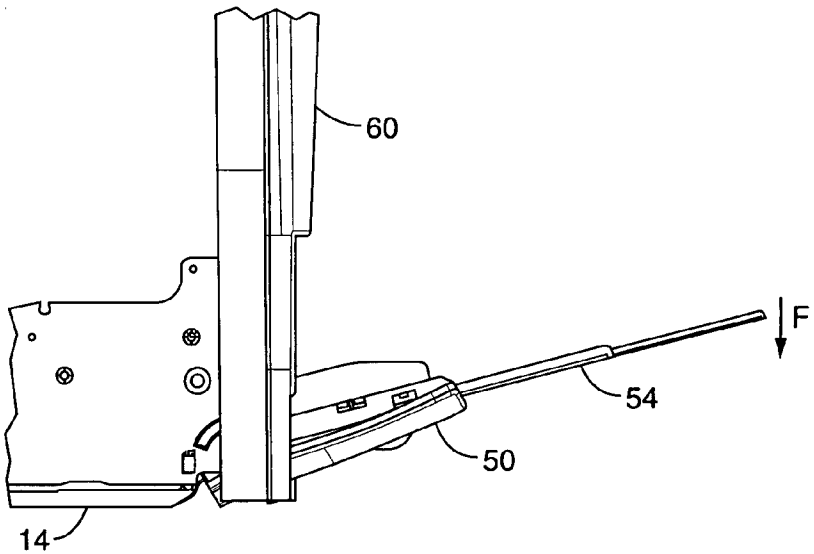
FIG. 3A
FIG. 3B
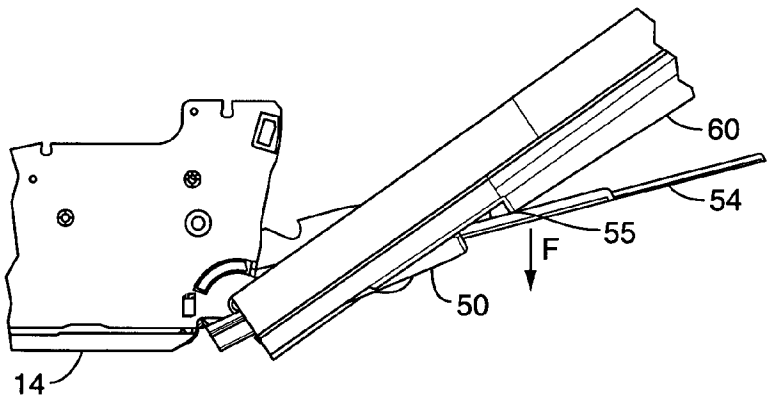
FIG. 3C
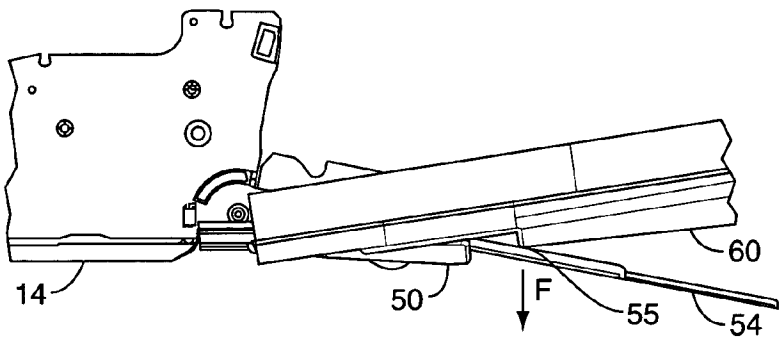
FIG. 3D

ROBUST DOOR PANEL BREAKAWAY MECHANISM FOR AN IMAGE FORMING DEVICE

BACKGROUND

Image forming devices often have door panels disposed about the exterior housing of the device. These door panels may be opened and closed as needed to access the interior of the device. For example, door panels may be provided to feed specialty media sheets, clear paper jams, and replace consumable items. In the latter two examples, the door panels may be opened just long enough to perform the necessary task. That is, a user may open the door panel, clear a paper jam or replace a component such as a toner cartridge, and then close the door to resume operation.

In other instances, the door panel may remain open for extended periods. One example is a multipurpose door that may be used periodically to feed specialty media such as forms, envelopes, or transparencies into the image forming device. Certain multipurpose media door panels are designed so they do not interfere with normal operation of the image forming device and may remain open indefinitely. Thus, for users who regularly feed specialty media into the multipurpose feeder, there is no absolute need to open and close the multipurpose door panel each time the multipurpose feeder is used.

Door panels in image forming devices may be designed to open a limited amount to prevent damage to door hinges. Often, a mechanical interference such as a detent or a hard stop is used to limit door travel. Unfortunately, door panels are sometimes opened beyond their intended range of travel. Items may be dropped on an open door panel or persons may lean or bump into the open door panel. In a worst case, the door hinges are destroyed and the damaged parts must be serviced and replaced. This scenario results in unwanted downtime. Some designs use a breakaway feature that permits travel beyond the intended range. For example, plastic snaps or other integrated latches may release their hold if a sufficient force is applied to the door panel. Afterwards, the door panel may be returned to its initial state. Unfortunately, snaps, latches, and other release mechanisms are subject to cyclic fatigue and may ultimately break after a certain number of cycles.

Furthermore, certain types of breakaway mechanisms rely on a tightly controlled fit between two or more parts. Thus, the parts must be manufactured to exacting processes and material standards. Problems such as material defects, tooling errors, and poor process control may lead to high failure rates. At one extreme, the breakaway mechanism may not release as intended, resulting in damage that the mechanism was intended to prevent. At another extreme, the breakaway mechanism may release too easily and door panels may not stop at the intended limit. This latter example may be particularly problematic for multipurpose door panels as they may not be able to support the weight of specialty media.

An added problem arises as image forming devices are incorporated in smaller packages. Rigid space constraints tend to limit size and placement of door panels. In certain instances, there may be some amount of overlap between one or more door panels. In other instances, there may be door panels disposed within door panels. In these cases, one door panel may need to be closed before opening another. If these door panels are not opened or closed in the proper order, a resulting interference between the door panels may force one or more panels to open past their intended range of travel. As these types of compound door designs become more common, the importance of a robust breakaway design increases. Existing breakaway mechanisms may not provide an optimal solution for these problems.

SUMMARY

The present application is directed to embodiments of a breakaway device that may be used on a door panel of an image forming device. Suitable door panels may include a multipurpose feed door or other door panels that are opened to provide access to the interior of the image forming device. A door panel may be movable between a closed position and an open position. The embodiments of the breakaway device disclosed herein may allow a door panel to release beyond the open position into what may be termed a breakaway position.

The breakaway device may comprise a resilient member and a deflectable stopper member. In general, the deflectable stopper member may be biased by the resilient member into a first stopper position. The stopper member may be retained in the first stopper position when the door panel is positioned between the closed position and the open position. The door panel may have a door contact surface that abuts against the stopper member when the door panel is placed in the open position. The deflectable stopper member may be displaced by the door contact surface to a second stopper position against a bias force applied by the resilient member when the door panel is positioned between the open position and the breakaway position.

Certain geometric features of the stopper member may improve the breakaway function. A curved surface may be used at the point of contact between the stopper member and the door contact surface to decrease sliding resistance. Other tapered features may also promote deflection of the stopper member when the door panel is moved beyond the open position.

BRIEF DESCRIPTION OF THE DRAWINGS

FIGS. 3A-3D are schematic illustrations showing multiple orientations for various door panels of an image forming device according to one embodiment of the present invention;

DETAILED DESCRIPTION

Figure 1A:
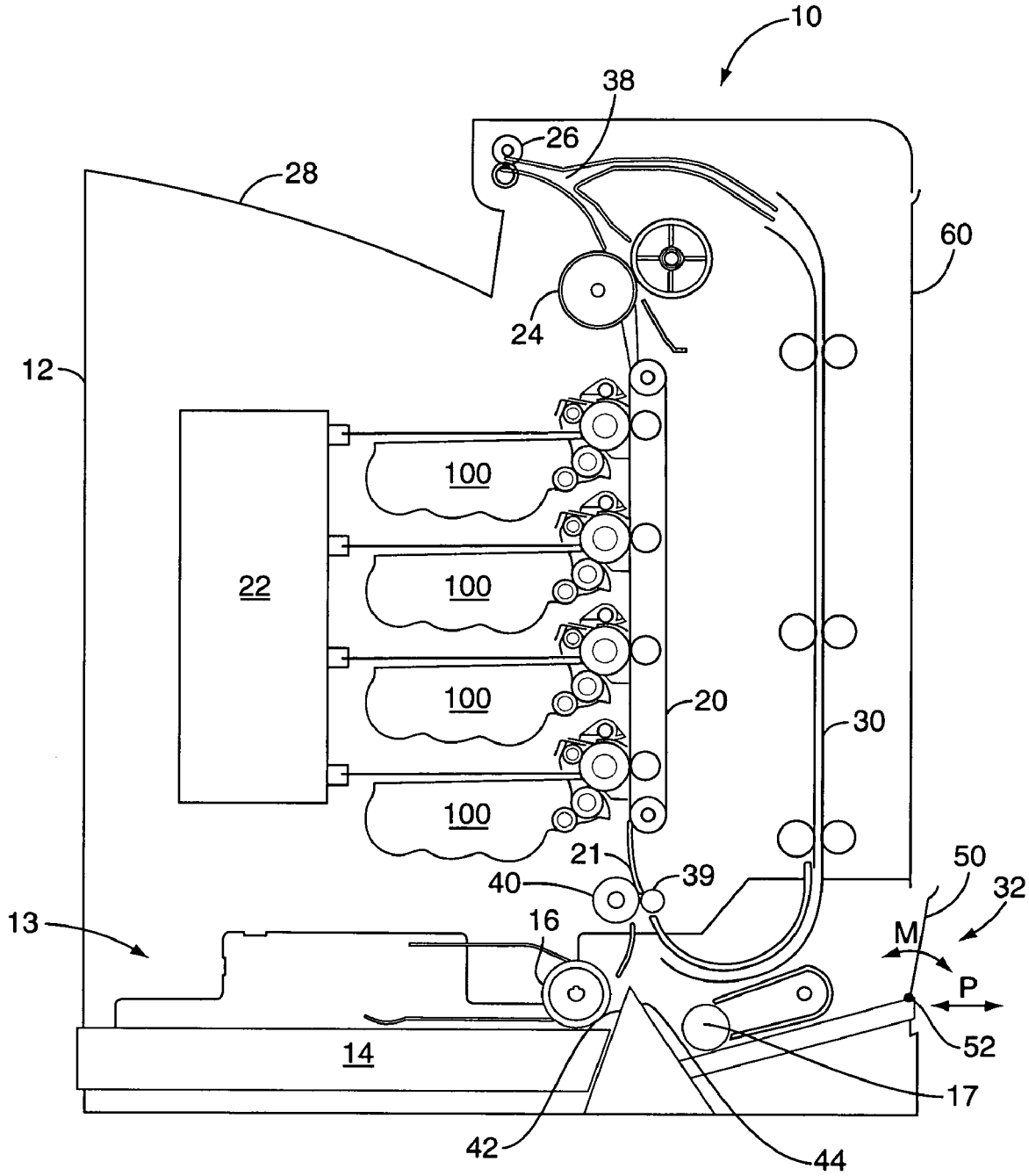
FIGS. 1A and 1B are schematic illustrations of an image forming device according to one embodiment of the present invention.
Figure 1B:
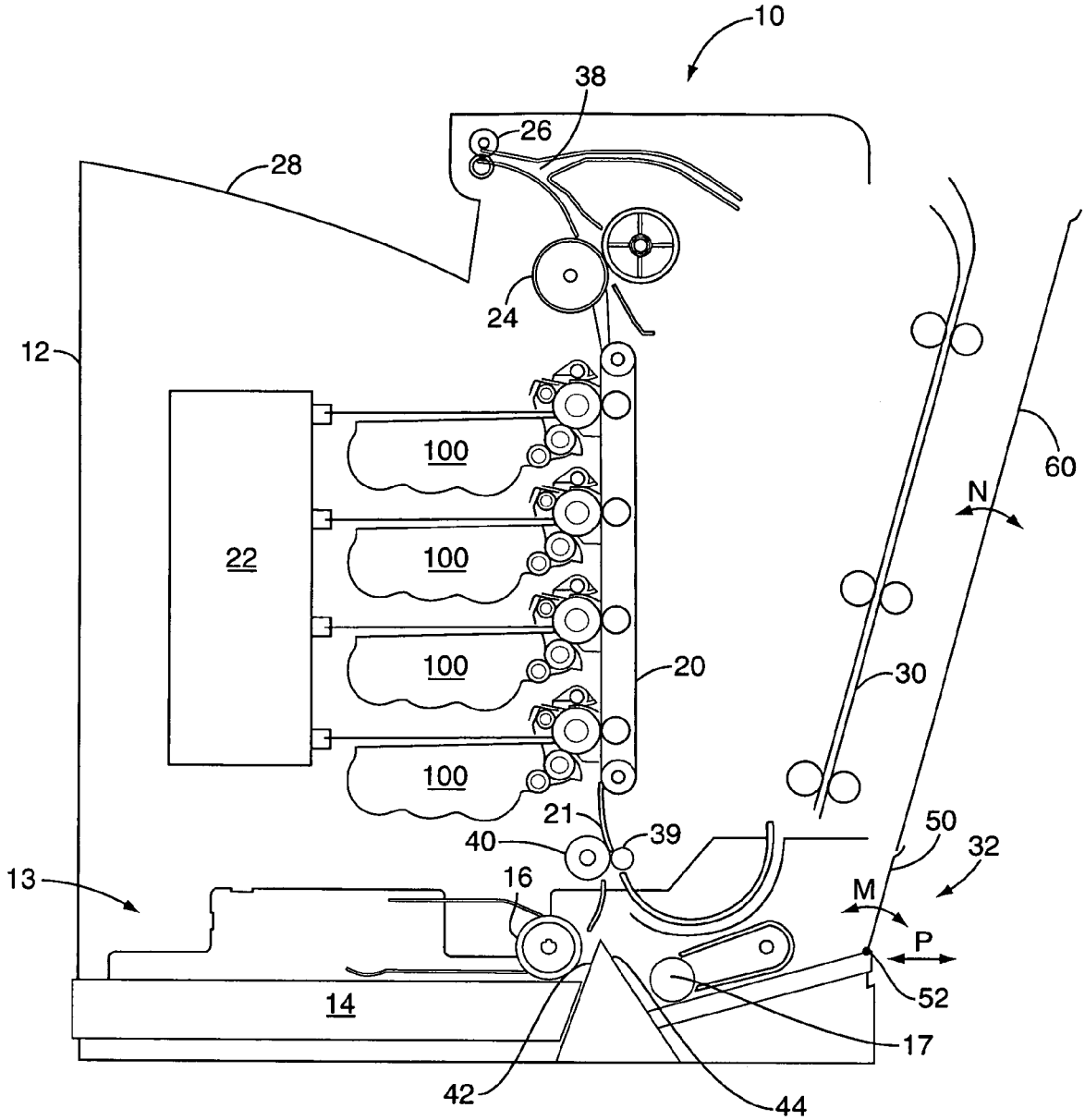

The various embodiments disclosed herein are directed to a breakaway mechanism for use in conjunction with a door panel on an image forming device as generally illustrated by the numeral 10 in FIGS. 1A and 1B. FIGS. 1A and 1B show a representative image forming device, such as a printer, according to one embodiment of the present invention. The exemplary image forming device 10 comprises a main body 12, at least one media input section 13 holding a print media tray 14, a pick mechanism 16, registration rollers 39, 40, a media transport belt 20, an optical device 22, a plurality of image forming stations 100, a fuser roller 24, exit rollers 26, an output tray 28, and a duplex path 30. The components and operation of image forming device 10 are conventionally known; however, a brief discussion is included below for clarity.

The exemplary image forming device 10 of FIG. 1 includes a first input section 13 and a multipurpose input section 32. Multiple input sections allow for storing or introducing multiple types and sizes of media that may be picked and fed into the media path 21 as required. The input sections may also be sized to hold a large capacity of media sheets. The first input section 13 includes a media tray 14 with a pick mechanism 16 to introduce media sheets into the media path 21 responsive to the receipt of a pick command. The multipurpose input section 32 may also be located in a main body 12 to introduce media sheets into the media path 21. Multipurpose input section 32 includes an associated pick mechanism 17 to feed media sheets introduced by a user from outside the body 12 of image forming device 10. The media tray 14 may be removable as indicated by arrow P for refilling, and located on a lower section of the device 10.

Media may be introduced into the multipurpose input section 32 through a multipurpose door panel 50. In the embodiment shown in FIG. 1A, the multipurpose door panel 50 is shown in a partially open position and pivots about point 52 in the direction generally indicated by arrows M. As described below, this multipurpose door panel 50 opens a sufficient amount to permit the insertion of specialty media, such as envelopes, forms, and transparencies for feeding by pick mechanism 17.

From the various input sections 13, 32, media sheets are deflected by guides 42, 44 towards the main media path 21. One or more registration rollers 39, 40 disposed along the media path 21 aligns the media sheet and precisely controls its further movement. A media transport belt 20 forms a section of the media path 21 for moving the media sheets past a plurality of image forming units 100. In a typical color electrophotographic printer such as exemplary device 10, three or four colors of toner—cyan, yellow, magenta, and optionally black—are applied successively to a print media sheet to create a color image. Correspondingly, the embodiment of FIGS. 1A and 1B depicts four image formation stations 100 arrayed along a media transport belt 20. The transport belt 20 carries the media sheet successively past the image formation stations 100. At each station 100, optical device 22 forms a latent image onto an associated photoconductive member or PC drum (not specifically labeled). The latent image is then developed by applying toner to the PC drum. The toner is subsequently deposited on the media sheet as it is conveyed past the image formation station 100.

Once the media sheet moves past the image forming stations 100, a fuser 24 thermally fuses the loose toner to the media sheet. The sheet then passes through reversible exit rollers 26 to the output stack 28 formed on the exterior body 12 of image forming device 10. Alternatively, the exit rollers 26 may reverse motion after the trailing edge of the media sheet has passed the entrance to a duplex path 38, thus directing the media sheet through the duplex path 30 and again into media path 21 to print a duplex image on the opposite side of the media sheet. It should be understood that while the foregoing description relates to a color electrophotographic printer as shown in FIG. 1, the present invention is not limited to color printers, but may be advantageously applied to other types of image forming devices 10, including but not limited to, single-color laser printers and inkjet printers.

The image forming device 10 shown in FIGS. 1A and 1B also includes a second movable door panel 60. As FIG. 1B shows, this second door panel 60 is generally larger than multipurpose door panel 50. In one embodiment, the multipurpose door panel 50 may be disposed entirely within the second door panel 60. The second door panel 60 may be opened to provide access to the interior of the image forming device 10. For instance, the second door panel 60 may be opened as needed to clear paper jams or replace consumables associated with each image forming station 100. In one embodiment, the duplex media path 30 rotates with the second door panel 60 to provide improved access to the interior of the image forming device 10. The second door panel 60 may pivot in a direction generally indicated by the arrows labeled N. Further, the second door panel 60 may pivot about the same pivot point 52 as multipurpose door panel 50. In other embodiments, the second door panel 60 and the multipurpose door panel 50 may pivot about different points. In either case, the second door panel 60 and the multipurpose door panel 50 are independently movable as indicated by the arrows labeled M and N.

Figure 2:
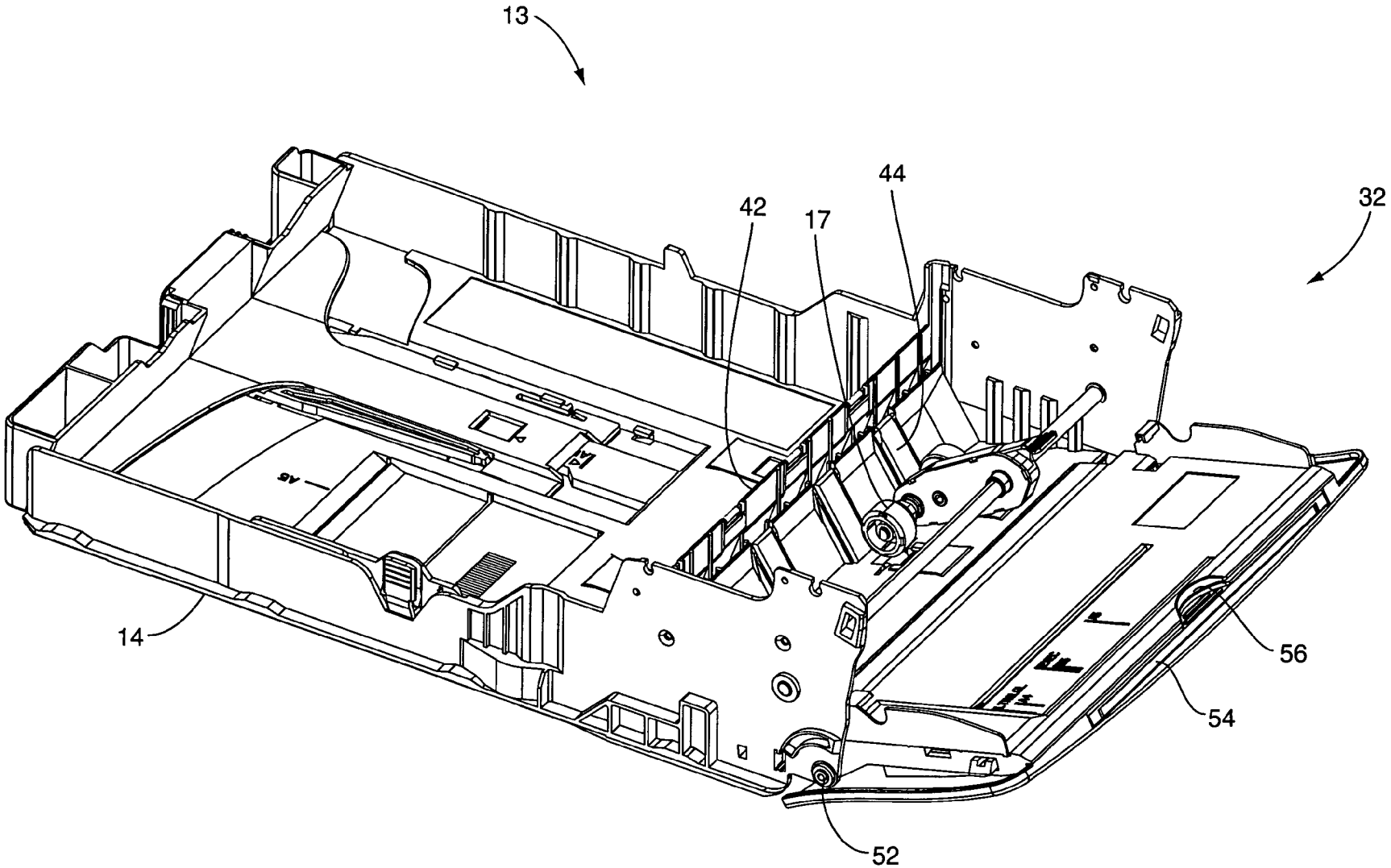
FIG. 2 is a schematic illustration of a media tray comprising multiple input sections according to one embodiment of the present invention.

In the embodiment shown in FIGS. 1A and 1B, the multipurpose door panel 50 is positioned on an exterior portion of the media tray 14. This configuration is more clearly represented in the perspective view of the media tray 14 shown in FIG. 2. As FIG. 2 illustrates, the media tray 14 combines input sections 13, 32 into a common assembly, thus conserving vertical space in the image forming device 10. Also visible in FIG. 2 are the aforementioned guides 42, 44 and the multipurpose pick mechanism 17. In the present embodiment, a retractable media support plate 54 is disposed within the multipurpose door panel 50. This media support plate 54 is shown in the retracted position in FIG. 2 and in FIG. 3A, which shows a partial side view of an open multipurpose door panel 50 relative to a closed second door panel 60. The media support plate 54 can be accessed from the finger recess 56 and pulled into the extended position shown in FIG. 3B. Note that in the positions shown in FIGS. 3A and 3B, the multipurpose door panel 50 is fully opened. That is, the multipurpose door panel 50 is opened to the point where it has reached a mechanical stop defining a limit of its normal range of motion. In this open position, the multipurpose door panel 50 and the media support plate 54 extend outward from the image forming device 10 and may be susceptible to inadvertent downward forces indicated by the arrow labeled F. For example, users may inadvertently hit or objects may fall on the open multipurpose door panel 50 and media support plate 54.

In other instances, the large breakaway forces may be caused by interference with other parts of the image forming device 10. FIGS. 3C and 3D show one such scenario. As indicated above, the second door panel 60 may be opened independent of the multipurpose door panel 50. As FIG. 3C illustrates, there may be interference at point 55 between this second door panel 60 and an extended media support plate 54. Therefore, if the second door panel 60 is opened beyond the position shown in FIG. 3C, a downward force F is exerted on the multipurpose door panel 50 at the interference point 55 causing the multipurpose door panel 50 to break away and open to the position shown in FIG. 3D.

Figure 4A:
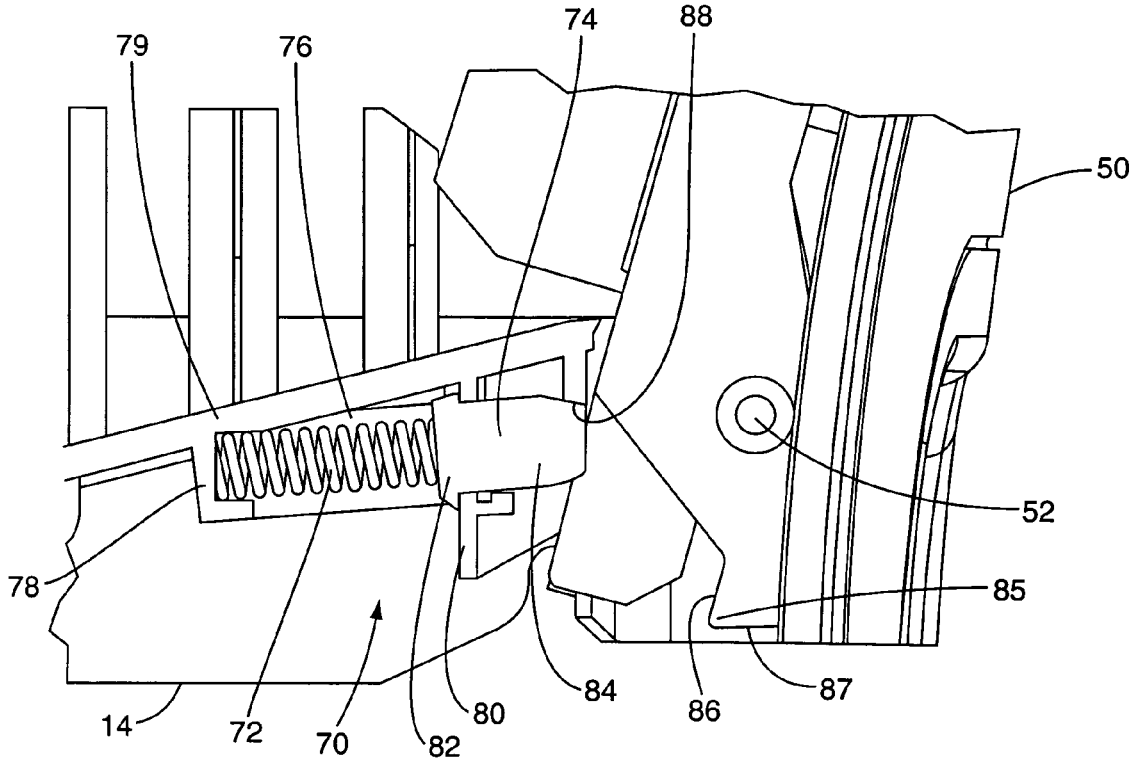
FIGS. 4A-4C are schematic illustrations showing multiple orientations for a breakaway device usable with a door panel on an image forming device according to one embodiment of the present invention.
Figure 4B:
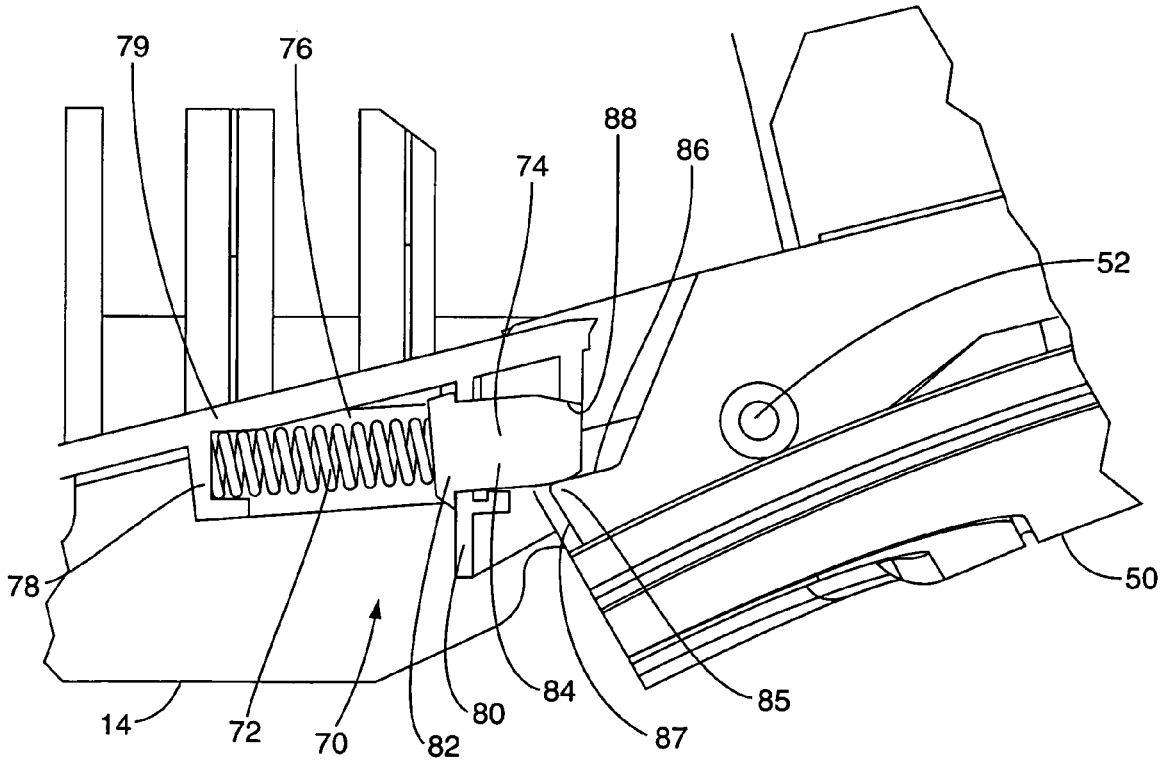
Figure 4C:
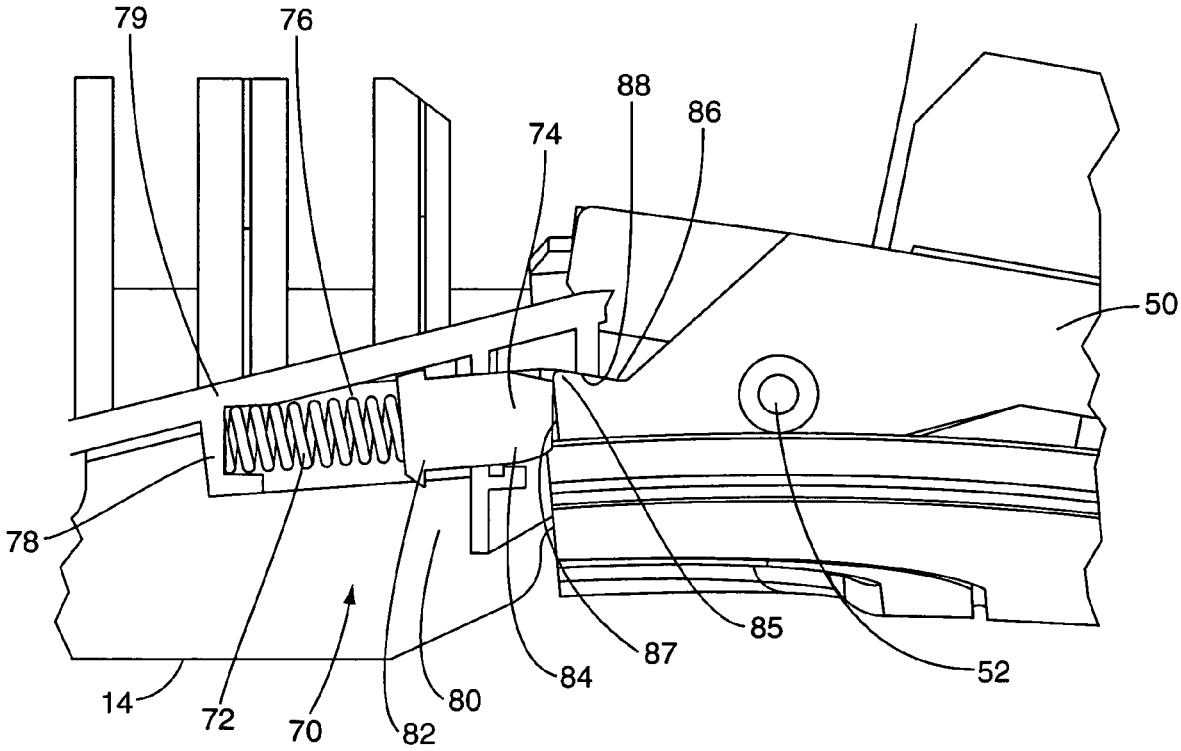

Accordingly, a breakaway device 70 as shown in FIGS. 4A-4C may be used to prevent damage to the multipurpose door panel 50 and its related pivot point 52. In the embodiment shown in FIGS. 4A-4C, the breakaway device comprises a resilient member 72 and a stopper member 74. Furthermore, the associated geometric interfaces between these members 72, 74, the media tray 14, and the multipurpose door panel 50 may improve the functionality of the breakaway device 70. The resilient member 72 and the stopper member 74 are retained within a channel 76 that is defined in part by walls 78, 79, 80. The stopper member 74 includes an enlarged base portion 82 that is disposed on the channel 76 side of wall 80 while a remaining stem portion 84 of the stopper member 74 protrudes through an aperture in wall 80 in the general direction of the multipurpose door 50. Note that while these various elements are disposed on a portion of the media tray 14, they may be disposed on the image forming device 10, such as on the housing 12.

In FIG. 4A, the multipurpose door panel 50 is illustrated in a closed position. In this position, there is no contact between the stopper member 74 and the multipurpose door panel 50. As the multipurpose door panel 50 is opened, a projection 85 associated with the multipurpose door panel 50 is brought into engagement with the stem portion 84 of stopper member 74 as shown in FIG. 4B. Specifically, a first door contact surface 86 of this projection 85 abuts the stopper member 74. In this open position, the stem portion 84 is pinched between the door contact surface 86 and a housing contact surface 88 located on an opposite side of the stem portion 84. In one embodiment, the stopper member 74 is comprised of a hard resin material that resists compression. Thus, the multipurpose door panel 50 may be maintained in the open position shown in FIG. 4B with resistance against further opening provided in part by the compressive strength of the stopper member 74.

In the event a large opening force is applied to a multipurpose door panel 50 that is already in the open position, the stopper member 74 is configured to deflect against the bias resistance provided by the resilient member 72 as shown in FIG. 4C. This deflection may be seen by noting the distance between the enlarged base portion 82 and the wall 80 against which the enlarged base portion 82 is normally biased (see FIGS. 4A, 4B). When the stopper member 74 deflects as shown in FIG. 4C, and the multipurpose door panel 50 rotates about pivot 52, the door contact surface 86 is moved into engagement with contact surface 88. Thus, the position shown in FIG. 4C represents a second, hard stop for the multipurpose door panel 50. Simultaneously, a second contact surface 87 of projection 85 pushes stopper member 74 against the bias force provided by the resilient member 72. It should be understood that while the projection 85 is depicted as comprising two distinct contact surfaces 86, 87, the projection 85 may more generically encompass a continuous contact surface with different portions of the contact surface engaging the stopper member 74 depending on the position of multipurpose door panel 50. Accordingly, the projection 85 may comprise a tapered, cammed, elliptical or otherwise curved surface.

Notably, the resilient member 72 provides a repeatable bias force against the stopper member 74. Thus, closing the multipurpose door panel 50 from the breakaway position shown in FIG. 4C towards the open or closed positions shown in FIGS. 4B and 4A, respectively, will reset the breakaway device 70 to its original state. Accordingly, the breakaway device 70 may simultaneously function as a door stop during normal use and as a security feature allowing additional door panel 50 movement if inadvertent forces are applied to an open door panel 50.

Figure 5A:
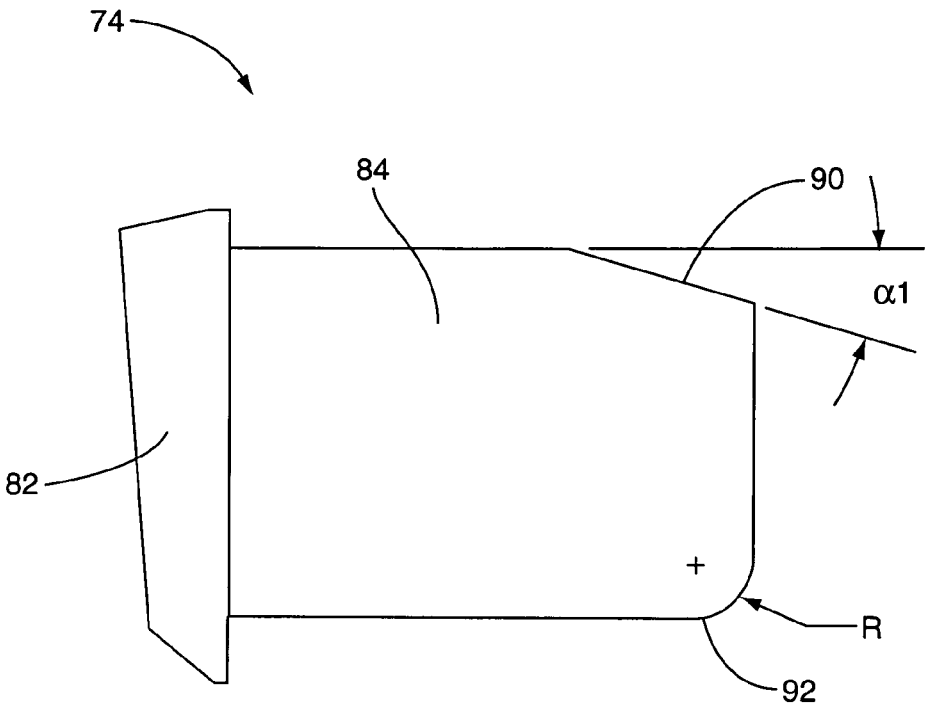
FIGS. 5A and 5B are schematic illustrations showing the shape of embodiments of a stopper element of a breakaway device usable with a door panel on an image forming device.
Figure 5B:
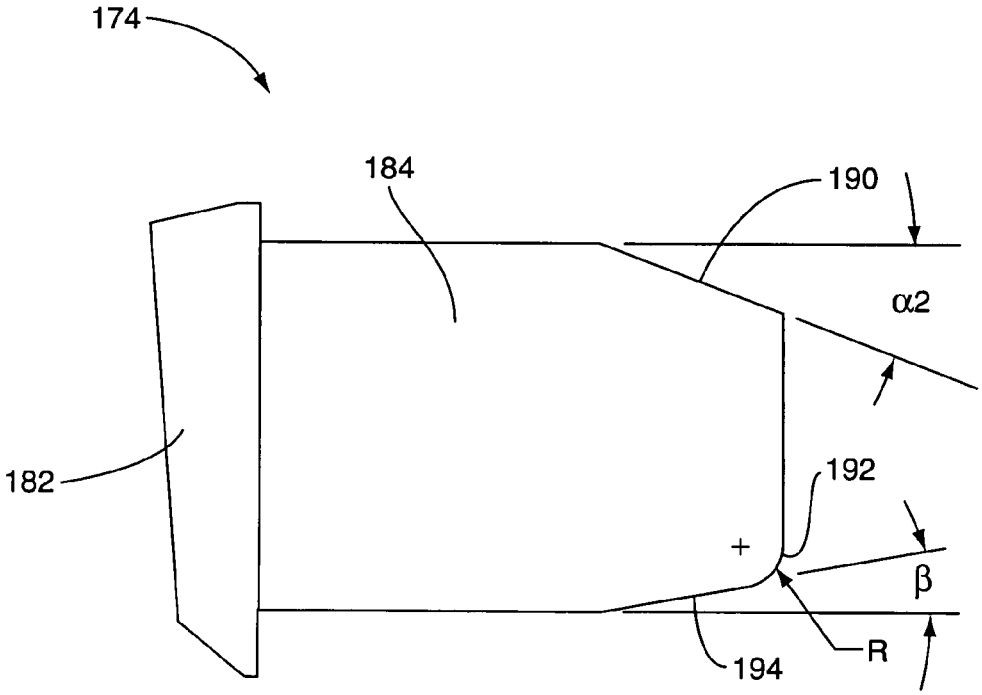

Certain geometric features of stopper member 74 are more readily apparent in FIGS. 5A and 5B. Specifically, the stopper member 74 may include tapered and rounded edges to promote deflection in the event the multipurpose door panel 50 is subjected to large opening forces. In one embodiment shown in FIG. 5A, a curved surface 92 may be disposed at or near the area of the stem portion 84 of stopper member 74 that contacts the door contact surface 86 (see FIG. 4B). This curved surface 92 may have a constant radius as depicted by dimension R in FIG. 5A. Alternatively, curved surface 92 may have a cam shape, elliptical shape, or variable radius shape. Regardless, the curved surface 92 may be configured to improve the likelihood that the door contact surface 86 can slide along the curved surface 92 while the stopper member 74 deflects as shown in FIG. 4C.

In addition, the stopper member 74 may include a tapered surface 90 that normally contacts housing contact surface 88 (see FIGS. 4A and 4B). This tapered surface 90 may be characterized by a taper angle represented by dimension $\alpha 1$ in FIG. 5A. This angle $\alpha 1$ is shown relative to the remainder of the stem portion 84. In one embodiment, housing contact surface 88 has the same taper angle $\alpha 1$. Thus, when the multipurpose door panel 50 is subjected to large opening forces, the interface between tapered surface 90 and housing contact surface 88 imparts a force component that tends to initiate deflection of the stopper member 74. In the embodiment shown in FIG. 5A, this force component may initiate deflection from right to left as shown in FIG. 4C.

An alternative embodiment of the stopper element 174 is shown in FIG. 5B. This stopper element 174 is similar to stopper element 74 except that the tapered surface 192 is arranged at a different angle $\alpha 2$. Similarly, stopper element 174 includes a curved surface 192. However, curved surface 192 is disposed adjacent to a second tapered surface 194 that is oriented at an angle $\beta$ relative to the stem portion 184. In one embodiment, the values for $\alpha 2$ and $\beta$ are approximately 15 degrees and 10 degrees, respectively. Larger or smaller angles may be used depending on material choice, door panel weights, and resiliency rates of the resilient member 72. For example, in the embodiment shown in FIG. 5A, the taper angle $\alpha$ may be approximately 5 degrees. Similarly, the radius of curved surface 92, 192 may be varied as appropriate for a given application. In one embodiment, a radius of between about 1 and 2 millimeters may suffice.

Figure 6:
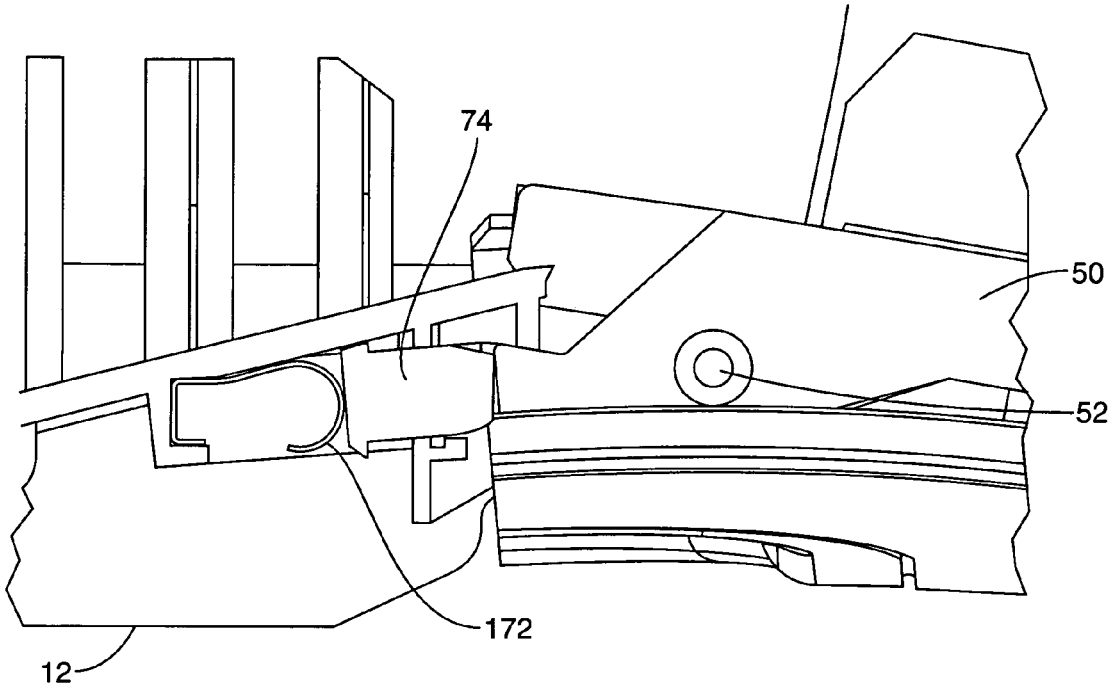
FIG. 6 is a schematic illustration of a breakaway device usable with a door panel on an image forming device according to one embodiment of the present invention.
Figure 7:
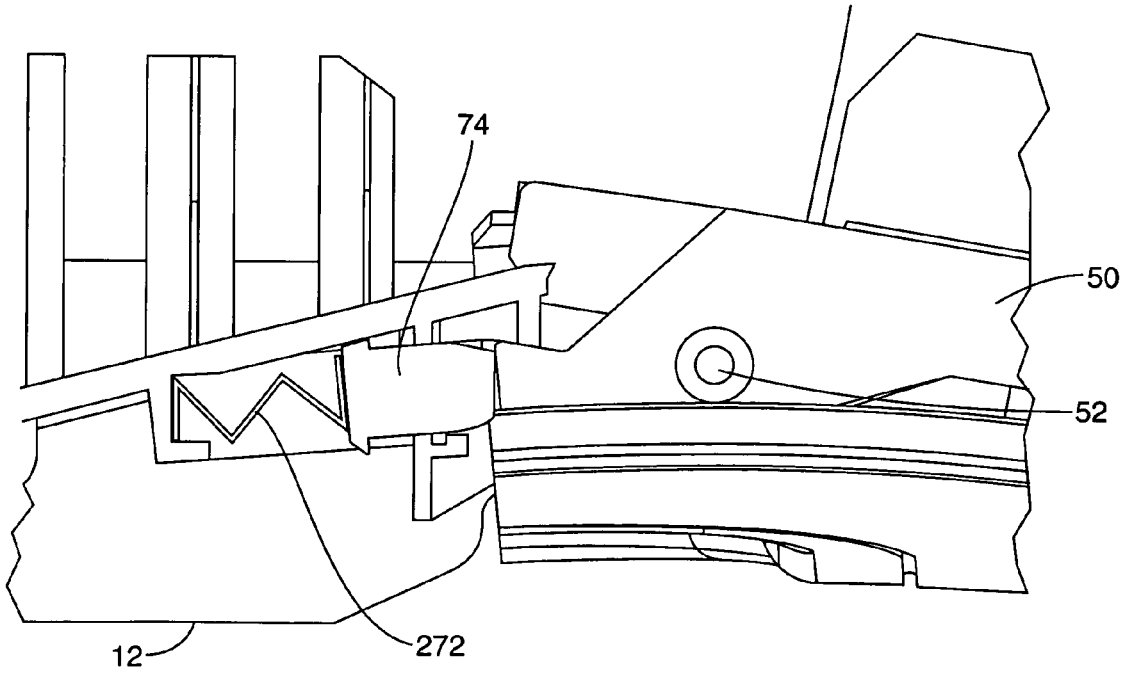
FIG. 7 is a schematic illustration of a breakaway device usable with a door panel on an image forming device according to one embodiment of the present invention.

The embodiments described above have been depicted in use with a coil spring as the resilient member 72. Coil springs are readily available as off the shelf items available in a variety of sizes and strengths to fit a particular application. See, for example, the embodiments shown in FIGS. 4A-4C. In alternative embodiments, other resilient members may be used. For example, a curved leaf spring 172 as shown in FIG. 6 may be used. In another alternative embodiment, the resilient member may be comprised as a corrugated leaf spring 272 as illustrated in FIG. 7. Leaf springs 172, 272 may be comprised of spring steel or other materials having high fatigue strength. Suitable material choices may include nickel alloys, including beryllium copper, and cobalt alloys, including titanium and inconel. Leaf springs may be custom designed to fit into tight spaces and to exhibit certain deflection properties.

Figure 8A:
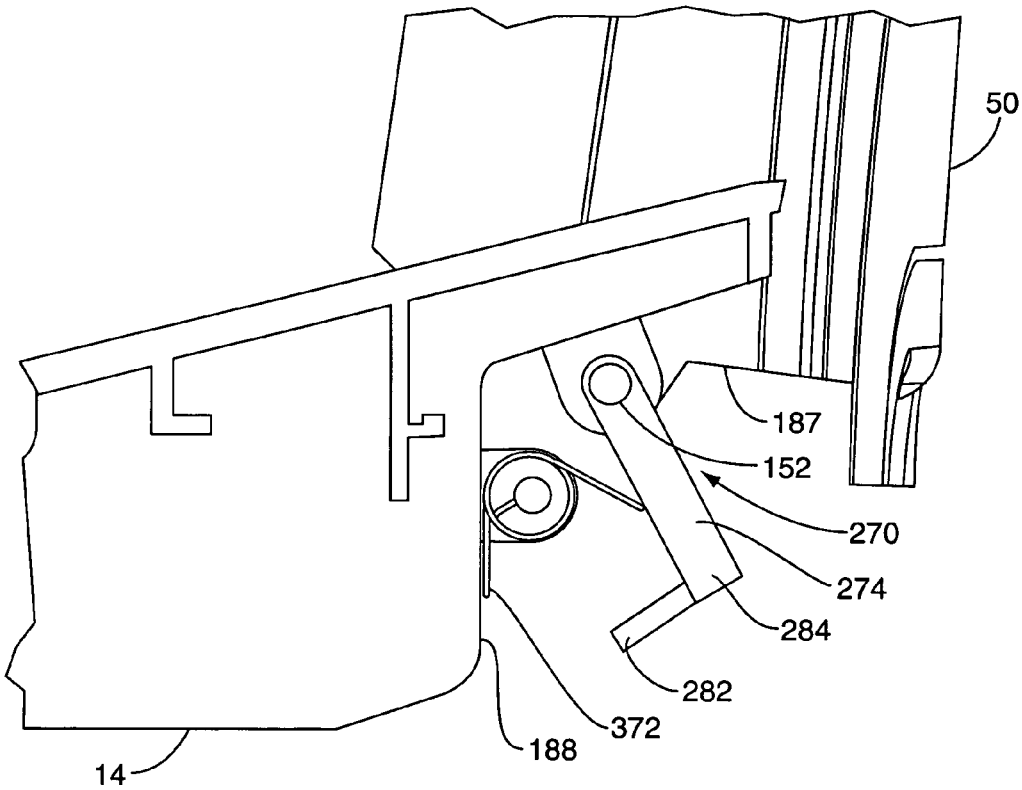
FIGS. 8A-8C are schematic illustrations showing multiple orientations for a breakaway device usable with a door panel on an image forming device according to one embodiment of the present invention.
Figure 8B:
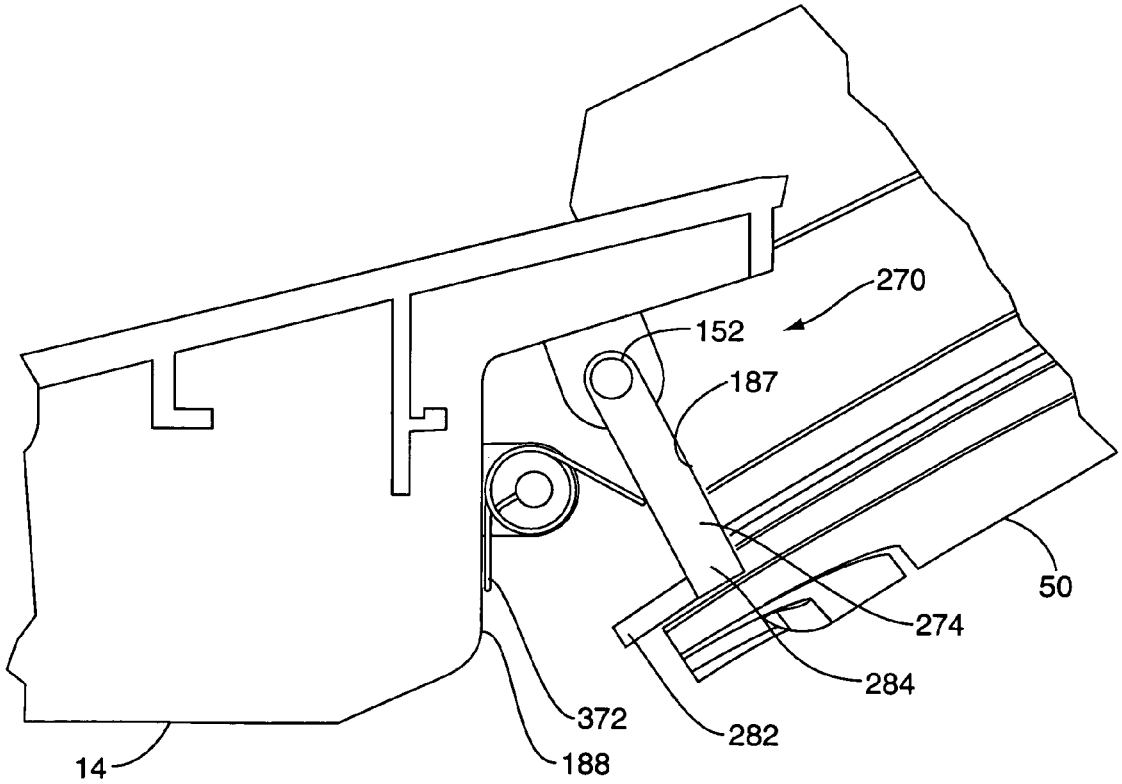
Figure 8C:
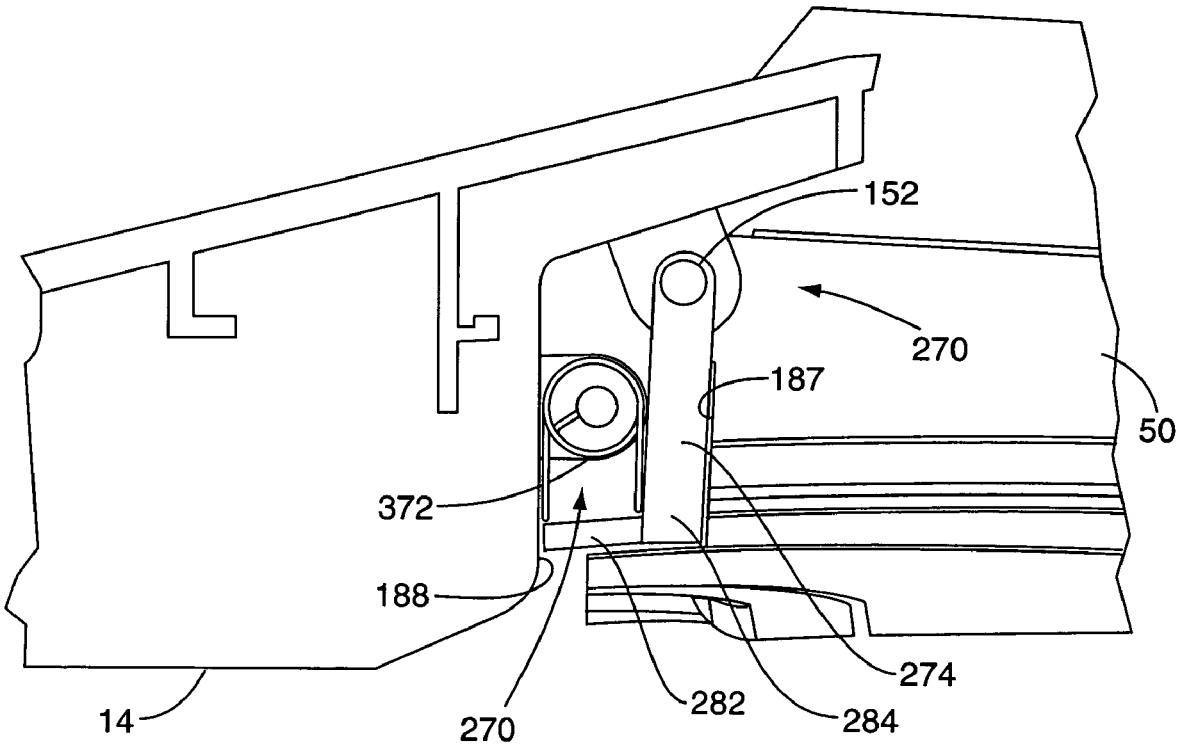

An alternative embodiment of a breakaway device 270 is shown in FIGS. 8A-8C. As with embodiments described above, this embodiment of a breakaway device 270 comprises a resilient biasing member 372 and a stopper member 274. In the embodiment shown, the resilient biasing member 372 is embodied as a torsion spring. Further, the illustrated stopper member 274 comprises a stem portion 284 and a blocking portion 282. In FIG. 8A, the multipurpose door panel 50 is illustrated in a closed position. In this position, there is no contact between the stopper member 274 and the multipurpose door panel 50. As the multipurpose door panel 50 is opened, a door contact surface 187 associated with the multipurpose door panel 50 is brought into engagement with the stem portion 284 of stopper member 274 as shown in FIG. 8B. In this open position, the door panel 50 is at least partly held open by the biasing force applied by bias member 372. In one embodiment, the bias member 372 has a sufficient strength to hold the door panel 50 and a stack of media sheets in a substantially fixed position. However, at the upper limit, the bias member 372 should not be so resistant to flexure as to unduly stress the attachment points, including pivot 152, when the door panel 50 is forced into the position shown in FIG. 8C.

In the event a large opening force is applied to a multipurpose door panel 50 that is already in the open position, the stopper member 274 is configured to deflect against the bias resistance provided by the resilient bias member 372 as shown in FIG. 8C. This deflection may be seen by noting that the stopper member 274 has pivoted about pivot 152. When the stopper member 274 deflects as shown in FIG. 8C, and the multipurpose door panel 50 rotates about pivot 152, the blocking portion of stopper member 274 is moved into engagement with housing contact surface 188. Thus, the position shown in FIG. 8C represents a hard stop for the multipurpose door panel 50.

Notably, the resilient member 372 provides a repeatable bias force against the stopper member 274. Thus, closing the multipurpose door panel 50 from the breakaway position shown in FIG. 8C towards the open or closed positions shown in FIGS. 8B and 8A, respectively, will reset the breakaway device 270 to its original state. Accordingly, the breakaway device 270 may simultaneously function as a door stop during normal use and as a security feature allowing additional door panel 50 movement if inadvertent forces are applied to an open door panel 50.

The present invention may be carried out in other specific ways than those herein set forth without departing from the scope and essential characteristics of the invention. For example, in the embodiments shown, the biased stopper member 74 is oriented so that it deflects in a substantially horizontal direction away from the door panel 50. This representative orientation, while advantageous in the embodiments shown, should not be construed as the only possible orientation. In other embodiments, depending on the door panel configuration, the stopper member 74 may be oriented so that it deflects in directions other than away from the door panel 50. The present embodiments are, therefore, to be considered in all respects as illustrative and not restrictive, and all changes coming within the meaning and equivalency range of the appended claims are intended to be embraced therein.

What is claimed is:

1. An access door panel assembly for use with an image forming device comprising:

a door panel providing access to an interior of the image forming device, the door panel pivotable between a first position, a second position, and a third position; and a breakaway device comprising a biasing member and a stopper member, the stopper member being urged by a bias force supplied by the biasing member into a first stopper position when the door panel is pivoted between the first position and the second position, the stopper member being displaced by the door panel to a second stopper position against the bias force when the door panel is pivoted between the second position and the third position.

2. The access door panel assembly of claim 1 wherein the door panel further comprises an associated door contact surface that pivots into and out of contact with the stopper member.

3. The access door panel assembly of claim 2 wherein the door contact surface is spaced away from the stopper member when the door panel is pivoted between the first position and the second position.

4. The access door panel assembly of claim 2 wherein the door contact surface is in contact with the stopper member when the door panel is pivoted between the second position and the third position.

5. The access door panel assembly of claim 2 wherein the stopper member is displaced to the second position by the door contact surface when the door panel is pivoted between the second position and the third position.

6. The access door panel assembly of claim 2 wherein the door contact surface contacts the stopper member in a first location when the door panel is in the second position and the door contact surface contacts the stopper member in a second location when the door panel is pivoted between the second position and the third position.

7. The access door panel assembly of claim 1 wherein the door panel provides access to a multipurpose media input.

8. The access door panel assembly of claim 1 wherein the door panel is substantially maintained in the second position through the bias force supplied by the biasing member.

9. An access door panel assembly for use with an image forming device comprising:

a door panel providing access to an interior of the image forming device, the door panel having an associated door contact surface, the door panel and the door contact surface pivotable between a first position, a second position, and a third position; and a breakaway device comprising a biasing member applying a bias force to a stopper member, the door contact surface being spaced from the stopper member when the door panel is pivoted between the first position and the second position, the stopper member contacting a first location on the door contact surface when the door panel is in the second position, and the stopper member contacting a second location on the door contact surface when the door panel is pivoted between the second position and the third position.

10. The access door panel assembly of claim 9 wherein the door panel provides access to a multipurpose media input.

11. The access door panel assembly of claim 9 further comprising a housing contact surface, the stopper member being compressed between the housing contact surface and the first location on the contact surface when the door panel is in the second position.

12. The access door panel assembly of claim 11 wherein the stopper member deflects in a first direction against the bias force when the door panel is pivoted between the second position and the third position, the housing contact surface being oriented at an angle other than parallel to the first direction.

13. The access door panel assembly of claim 9 wherein the stopper member comprises a curved stopper surface, the curved stopper surface contacting the first location on the door contact surface when the door panel is in the second position.

14. The access door panel assembly of claim 13 wherein the stopper member deflects in a first direction against the bias force when the door panel is pivoted between the second position and the third position, the door contact surface sliding along the curved stopper surface when the door panel is pivoted between the second position and the third position.

15. A method of providing access to the interior of an image forming device:

providing a door panel that is movable between a first door panel position and a second door panel position;

urging a stopper member into a first stopper position with a bias force when the door panel is in or between the first and second door panel positions;

abutting a door contact surface against the stopper member when the door panel is in the second door panel position; and deflecting the stopper member against the bias force when the door panel is opened beyond the second door panel position.

16. The method of claim 15 wherein deflecting the stopper member against the bias force when the door panel is opened beyond the second door panel position comprises deflecting the stopper member through contact between the door contact surface and the stopper member.

17. The method of claim 16 further comprising abutting a first location on the door contact surface against the stopper member when the door panel is in the second door panel position and abutting a second location on the door contact surface against the stopper member when the door panel is opened beyond the second door panel position.

18. The method of claim 16 wherein deflecting the stopper member through contact between the door contact surface and the stopper member comprises sliding the door contact surface along a length of the stopper member.

19. The method of claim 15 further comprising abutting the door contact surface against a housing contact surface when the door panel is opened beyond the second door panel position and into a third door panel position.

20. The method of claim 15 further comprising compressing the stopper member between the door contact surface and a housing contact surface when the door panel is in the second door panel position.

21. The method of claim 15 further comprising returning the stopper member to the first stopper position with the bias force when the door panel is returned into or between the first and second door panel positions after being opened beyond the second door panel position.

22. The method of claim 15 wherein urging a stopper member into a first stopper position with a bias force comprises retaining a resilient bias member and a portion of the stopper member in a channel, the resilient bias member urging the stopper member towards one end of the channel.

23. The method of claim 15 further comprising substantially maintaining the door panel in the second position by biasing the stopper member against a weight of the door panel.

* * * * *